US006193541B1

(12) United States Patent
Lee

(10) Patent No.: US 6,193,541 B1
(45) Date of Patent: Feb. 27, 2001

(54) IDC CONNECTOR

(75) Inventor: George Lee, Taipei (TW)

(73) Assignee: Hon Hai Precision Ind. Co., Ltd., Taipei Hsin (TW)

( * ) Notice: Subject to any disclaimer, the term of this patent is extended or adjusted under 35 U.S.C. 154(b) by 0 days.

(21) Appl. No.: 09/418,673

(22) Filed: Oct. 14, 1999

(30) Foreign Application Priority Data

Jun. 15, 1999 (TW) ..... 88209848

(51) Int. Cl.[7] ..... H01R 4/24
(52) U.S. Cl. ..... 439/405; 439/358
(58) Field of Search ..... 439/357, 358, 439/404, 405, 407, 435, 456, 459, 470, 492, 499

(56) References Cited

U.S. PATENT DOCUMENTS 4,006,957 * 2/1977 Narozny .
4,359,257 * 11/1982 Lopinski et al. .
4,621,885 * 11/1986 Szczesny et al. .
4,648,677 * 3/1987 Lang ..... 439/459
4,681,382 * 7/1987 Lockard ..... 439/497
4,960,390 * 10/1990 Davis et al. ..... 439/459
5,104,336 * 4/1992 Hatanaka et al. ..... 439/404
5,108,308 * 4/1992 Wellinsky et al. ..... 439/404
5,125,850 * 6/1992 Locati ..... 439/404
5,338,221 * 8/1994 Bowen et al. ..... 439/405
5,664,961 * 9/1997 Tsuji et al. ..... 439/358
5,762,513 * 6/1998 Stine ..... 439/358

* cited by examiner

*Primary Examiner*—Gary F. Paumen
(74) *Attorney, Agent, or Firm*—Wei Te Chung

(57) ABSTRACT

An electrical connector assembly for connecting of a flexible cable to a PCB comprises an elongate cover, an elongate electrical connector and an elongate header. The electrical connector includes an insulative housing and a plurality of terminals retained in the housing. The cover forms a pair of latching arms on opposite ends thereof. Each latching arm forms a hook portion. A plurality of parallel grooves is defined in a bottom surface of the cover. The header includes a shrouded housing and a plurality of contacts retained in the housing for engaging with the terminals of the electrical connector. A cutout is formed in each lateral surface of the shrouded housing.

1 Claim, 5 Drawing Sheets

IDC CONNECTOR

BACKGROUND OF THE INVENTION

The present invention generally relates to a IDC connector, and particularly to a IDC connector having a simple structure.

A conventional IDC (Insulation Displacement Connection) connector is disclosed in U.S. Pat. Nos. 4,006,957; 4,681,382; 5,104,336 and 5,762,513. Referring to FIG. 1, a conventional electrical connector assembly 8 comprises a header 99 mounted on a PCB (not shown), an elongate electrical connector 80, an elongate cover 82 and an elongate strain relief 84. The electrical connector 84 mated and received in the header 99 includes an elongate insulative housing 83 and a plurality of terminals 86 retained in the housing 83. The cover 82 is pre-assembled to the electrical connector 80 and defines a passage therebetween. A flexible cable 90 is inserted into the passage and a plurality of wires thereof coated with insulative material is aligned with the terminals 86. The cover 82 is further pressed and the flexible cable 90 is sandwiched between the cover 82 and the terminal 86. Each terminal 86 includes a pair of beams 88 and a mating portion 85 opposite the beams 88 for engaging with corresponding contacts 96 of the header 99. Each pair of beams 88 pierces the insulative material and contacts the corresponding wire therein. The strain relief 84 includes a pair of latching arms 87 at opposite ends thereof for securing the strain relief 84 to the header 99. However, such an electrical connector assembly 8 has a significant number of components thereby complicating assembly thereof. Thus, manufacture of the electrical connector assembly 8 is time and cost inefficient.

SUMMARY OF THE INVENTION

Accordingly, a first purpose of the present invention is to provide an electrical connector assembly having a simple structure.

A second purpose of the present invention is to provide an electrical connector assembly which can reliably engage with a flexible cable.

To fulfill the above-mentioned purposes, an electrical connector assembly for interconnecting a flexible cable and a PCB comprises an elongate cover, an elongate electrical connector and an elongate header. The electrical connector includes an insulative housing and a plurality of terminals retained in the housing. Each terminal includes a pair of beams and mating ends opposite the beams. The cover forms a pair of latching arms at opposite ends thereof. Each latching arm forms a hook portion. A plurality of parallel grooves is defined in a bottom surface of the cover. The header includes a shrouded housing and a plurality of contacts retained in the housing for engaging with the terminals of the electrical connector. A cutout is formed in each lateral surface of the shrouded housing. When the assembly of the cover and electrical connector is affixed as a unit, the hook portions of the cover snappingly engages with upper edges of the cutouts thereby securing the cover, the electrical connector and the header together.

DETAILED DESCRIPTION OF THE PREFERRED EMBODIMENT

Figure 1:
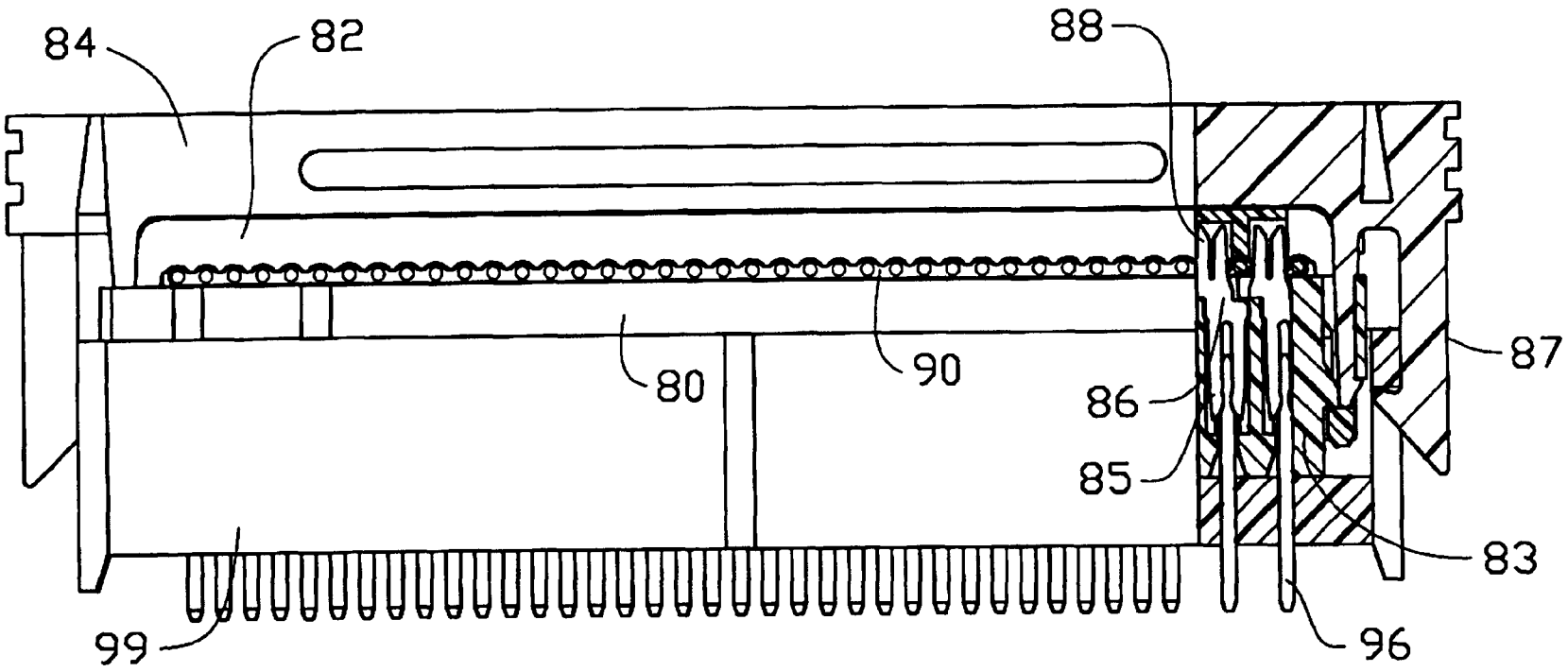
FIG. 1 (PRIOR ART)
FIG. 1 is a partial cross-sectional view of a conventional electrical connector assembly engaging with a flexible cable.
Figure 2:
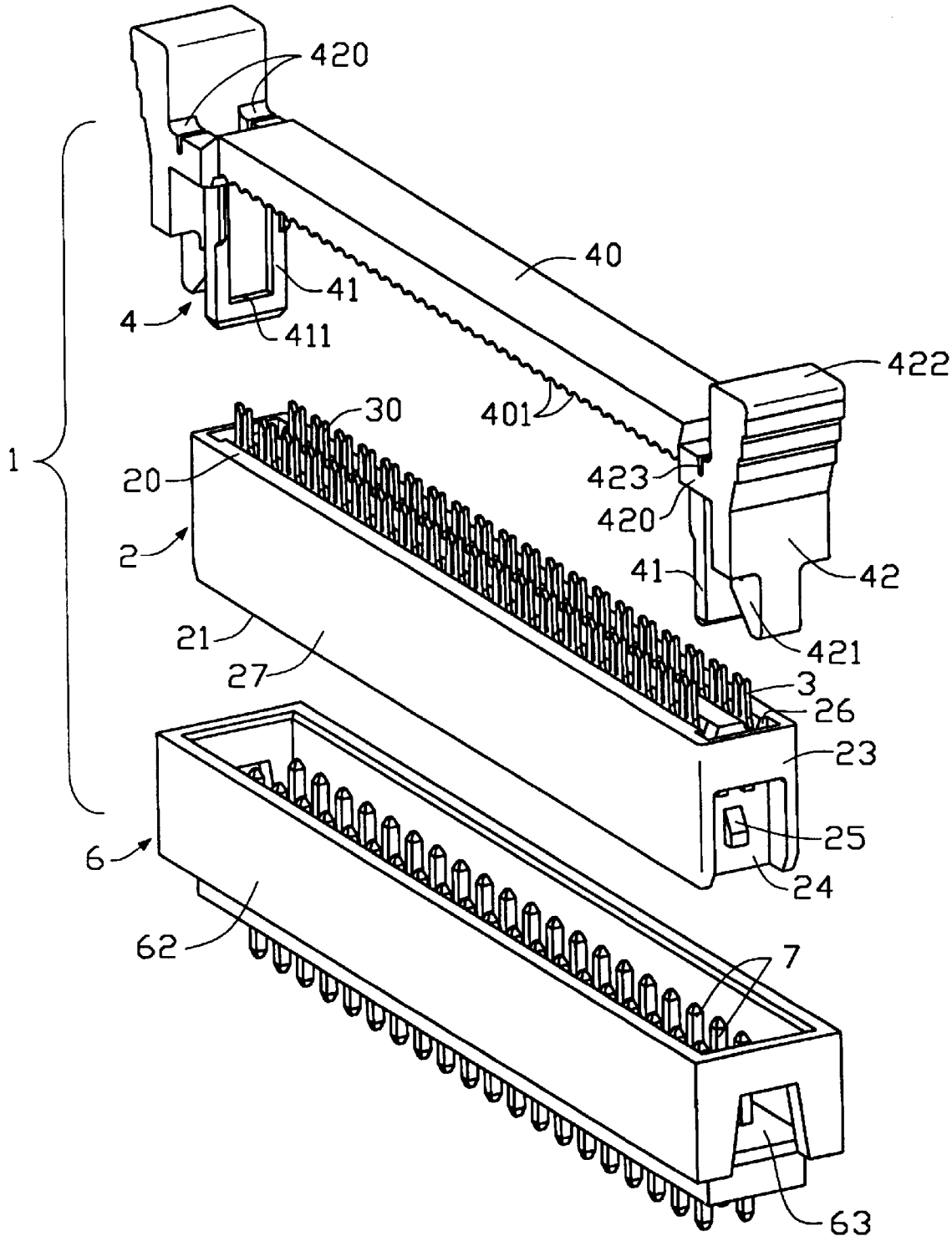
FIG. 2 is an exploded view of a conventional electrical connector assembly in accordance with the present invention.
Figure 3:
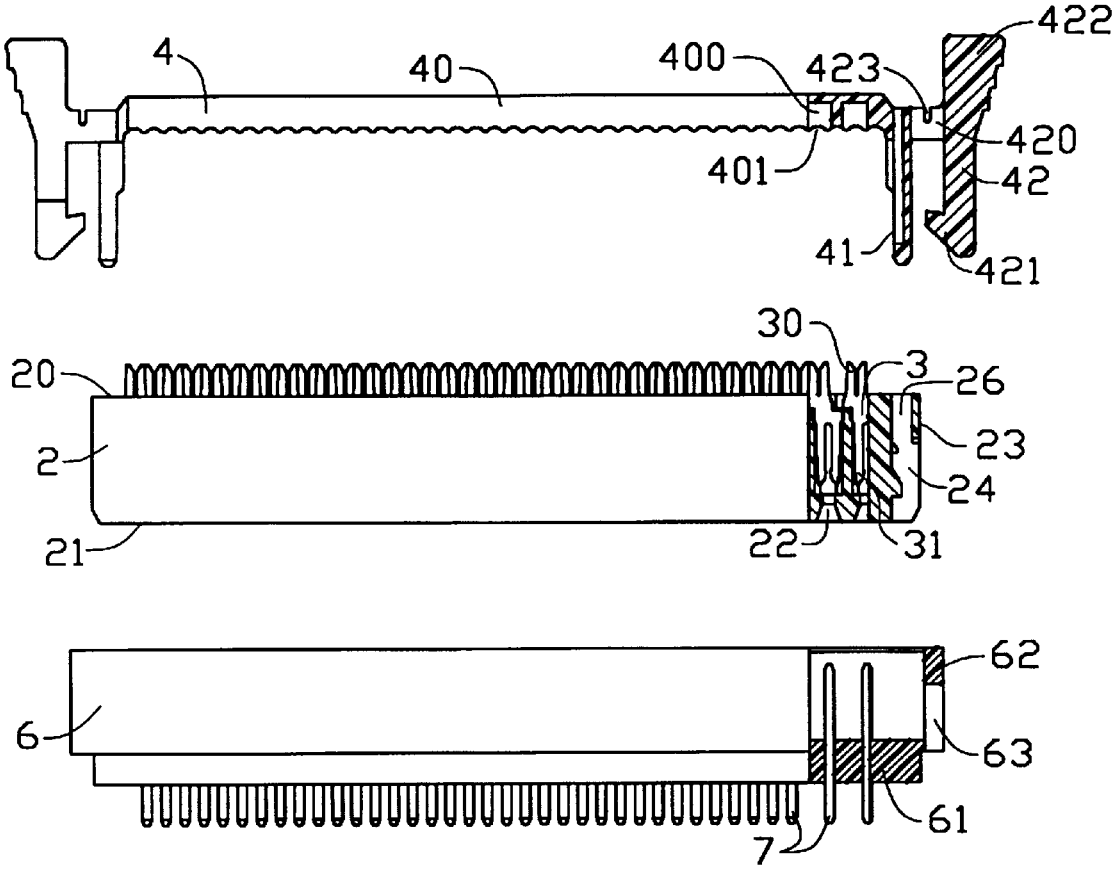
FIG. 3 is a side, partial cross-sectional view of the electrical connector assembly of FIG. 2.

Referring to FIGS. 2 and 3, an electrical connector assembly 1 in accordance with the present invention comprises an elongate cover 4, an elongate electrical connector 2 and an elongate header 6. The electrical connector 2 includes an insulative housing 27 and a plurality of terminals 3 retained in the housing 27. The housing 27 defines a plurality of passageways 22 between a first mating face 20 and a second mating face 21 opposite the first mating face 20 for receiving the terminals 3. Each terminal 3 includes a pair of beams 30 and a pair of mating ends 31 opposite the beams 30. A recess 24 is defined in each end of the housing 27. A tunnel 26 is defined by a yoke 23 formed proximate each end of the housing 27 in communication with the recess 24. An inclined engaging block 25 is formed on each end of the housing and projects into the corresponding recess 24.

The cover 4 comprises an elongate body 40 and a pair of integral latching arms 42 extending from opposite ends of the body 40. The latching arms 42 act as resiliently deflectable cantilever beams. Each latching arm 42 includes an actuation end 422 and a hook portion 421 opposite the actuation end 422. Each latching arm 42 is connected to the body 40 by a pair of spaced hinges 420. A slit 423 is defined in each hinge 420 for providing the latching arms 42 with further resiliency. A latching plate 41 downwardly extends from each hinge 420 and a latching bar 411 is formed between ends of the latching plates 41 corresponding to the engaging block 25 of the electrical connector 2. A plurality of parallel grooves 401 is defined in a bottom surface of the body 40 of the cover 4. A plurality of receiving apertures 400 is defined proximate the grooves 401 and aligned with the terminals 3 of the electrical connector 2.

The header 6 mounted on a PCB (not shown) includes an elongate shrouded housing 62 and a plurality of contacts 7 retained in the housing 62. A pair of cutouts 63 is formed in opposite ends of the shrouded housing 62.

Figure 4:
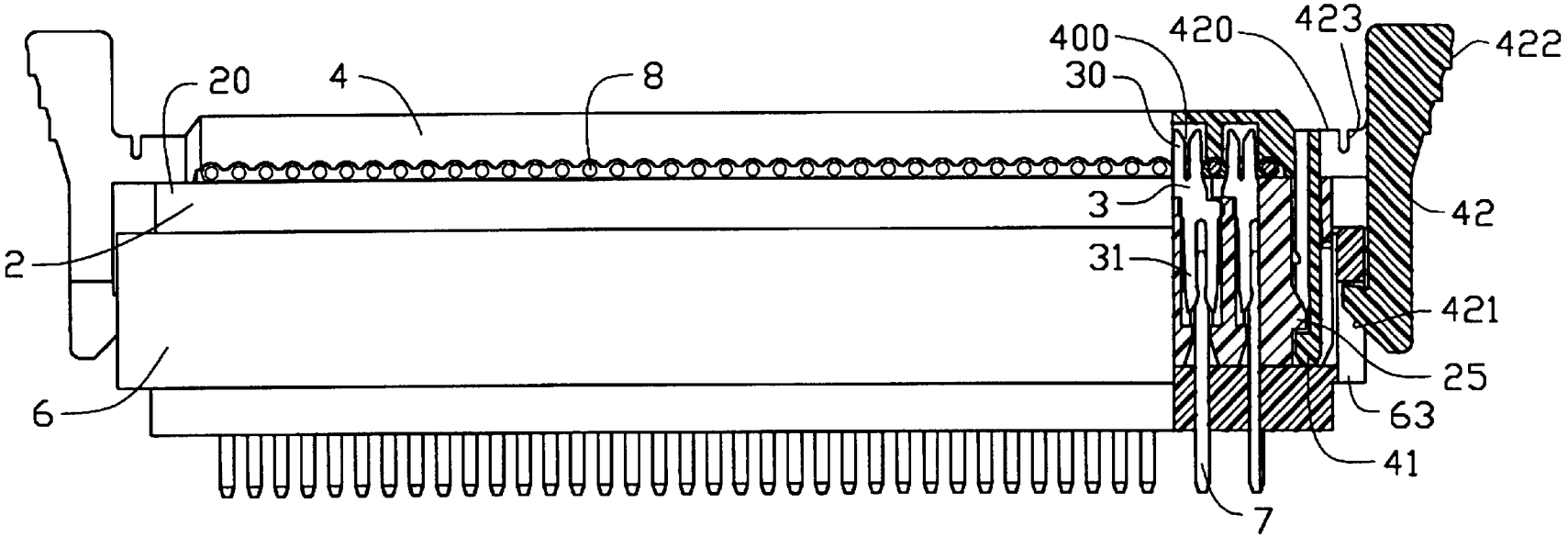
FIG. 4 is an assembled view of FIG. 3.
Figure 5:
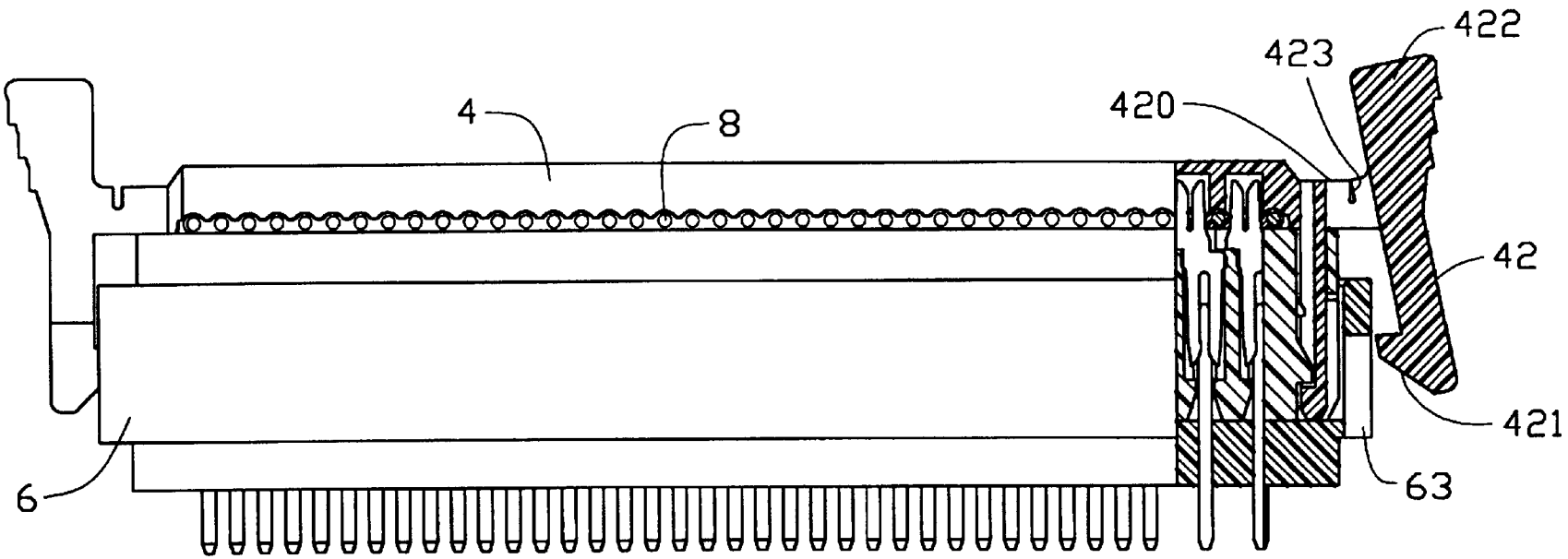
FIG. 5 is similar to FIG. 4 showing a partial, cross-sectional view of a hook of a cover disengaging with a block of an IDC connector.

Referring to FIGS. 4 and 5, in assembly, the cover 4 is pre-assembled to the electrical connector 6 with a passage defined therebetween. A flexible cable 8 including a plurality of wires (not labeled) and insulative material coating the wires is positioned in the passage. The wires are aligned with the terminals 3 and the apertures 400 of the cover 4. The cover 4 is downwardly pressed to urge the flexible cable 8 to engage with the terminals 3. Each pair of beams 30 pierces the insulative material and contacts the corresponding wire. The beams 30 are then received in the corresponding aperture 400 of the cover 4 thereby promoting a reliable engagement and proper positioning of the flexible cable 8 and the beams 30 of the terminals 3. The latching plates 41 extend through the tunnels 26 of the electrical connector 2. The latching bars 411 pass over and are engaged by the corresponding blocks 25 of the electrical connector 2. When the assembly of the cover 4 and electrical connector 2 is affixed as a unit, the electrical connector 2 is inserted into and mates with the header 6. The mating ends 31 of the terminals 3 engage with the corresponding contacts 7. The hook portions 421 of the cover 4 slide over the yokes 23 and snappingly engage with upper edges of the cutouts 63 of the header 6 thereby securing the unit of the cover 4 and the electrical connector 2 to the header 6. The actuation ends 422 of the cover 4 are exposed for manual operation to outwardly pivot the latching arms 42 with the hinges 420 acting as a fulcrum for detaching the unit of the cover 4 and the electrical connector 3 from the header 6. When opposite inner surfaces of each slit 423 contact each other, further pivotal movement of the latching arms 42 is prevented thereby limiting the amount of flexure of the hinges 423, as well as limiting internal stress in the hinges 423 during flexure.

Such an electrical connector assembly 1 for interconnecting the flexible cable 8 and the PCB has a simplified structure compared to the electrical connector assembly disclosed in the prior art. Thus, manufacture of the electrical connector assembly 1 is time and cost efficient. In addition, the electrical connector assembly 1 has a reduced number of components which facilitates transport and storage thereof.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claim is:

1. An electrical connector assembly for interconnecting a flexible cable and a PCB, comprising:

a header including a shrouded insulative housing and a plurality of contacts retained in the housing;

an electrical connector including an insulative housing and a plurality of terminals retained in the housing, each terminal including a pair of beams for terminating conductive wires of the flexible cable and a mating end opposite the beams for engaging with the contacts of the header; and a cover including a body and a pair of latching arms formed on two opposite ends of the body, each latching arm having first latching means for securely engaging with the header, second latching means being formed on the cover for securely engaging with the electrical connector, the body defining a plurality of grooves for pressing against wires of the flexible cable to engage with the terminals of the electrical connector;

wherein the first latching means of each latching arm of the cover includes a hook portion for engaging with an upper edge of a cutout defined in a corresponding end of the housing of the header;

wherein the second latching means includes a pair of latching plates and a latching bar formed therebetween;

wherein the housing of the electrical connector defines a recess in an end thereof and forms an engaging block projecting into the recess for engaging with the latching bar;

wherein a yoke is formed proximate the recess and defines a tunnel in communication with the recess for allowing extension of the latching plates therethrough;

wherein the body of the cover defines a plurality of apertures proximate corresponding slots for reliably receiving and properly positioning the beams of the terminals;

wherein the cover forms a hinge between each latching arm and the body;

wherein a slit is defined in each hinge for providing the hinge with resiliency.

* * * * *